United States Patent [19]

Bertonneau

[11] Patent Number: 4,458,912

[45] Date of Patent: Jul. 10, 1984

[54] COUPLING DEVICE FOR ASSEMBLING TWO PIECE SKIS

[76] Inventor: Gerald R. Bertonneau, 16667 Montego Way, Tustin, Calif. 92680

[21] Appl. No.: 370,364

[22] Filed: Apr. 21, 1982

[51] Int. Cl.[3] ..... A63C 5/02

[52] U.S. Cl. ..... 280/603; 403/322; 292/DIG. 49

[58] Field of Search ..... 280/603; 403/322, 316, 403/317; 292/DIG. 49, 158, 167, 139; 24/230 BC, 230 AP, 230 AT, 238

[56] References Cited

U.S. PATENT DOCUMENTS 3,026,546 3/1962 Kakes ..... 280/603

FOREIGN PATENT DOCUMENTS 780643 4/1935 France ..... 280/603

36887 2/1923 Norway ..... 280/603

*Primary Examiner*—David M. Mitchell
*Assistant Examiner*—Joseph McCarthy
*Attorney, Agent, or Firm*—Robert Louis Finkel

[57] ABSTRACT

A multi-portion ski fitted together with numerous shaped two-part metal coupling devices one part, usually forward, has two or more threaded metal ferrels protruding upward into which metal screws are fastened. The bottom plate on the connection portion slips over the ferrels forming a tight fit. The top plate, of about one half the size, adjustably locks the bottom plate into place by interacting with slots in the sides of the ferrels. An adjustable screw controls the tension of the locking portion of the coupling device which should always tightly lock the portions together without deformation of parts.

2 Claims, 5 Drawing Figures

COUPLING DEVICE FOR ASSEMBLING TWO PIECE SKIS

BACKGROUND OF THE INVENTION

1. Field of the Invention

This invention is concerned with skis in general and particularly it relates to skis that are in two or more segments able to be disassembled and assembled easily.

2. Description of the Prior Art

One of the problems facing the ski industry is that of theft. Skis are normally over four feet in length and are transported on special racks fastened to cars. While some of these racks contain locks most expose the skis to view. These racks are easily broken into and the skis stolen.

To overcome this objection numerous designs of two piece skis have been invented with the object of providing a ski that can be disassembled into segments and locked in the trunk of automobiles and be safe and out of sight.

Firstly a water ski best illustrated by U.S. Pat. No. 3,026,546 in which two flat surfaces are mated, one overlapping the other at the attachment joint. This method may be suitable for water skiing but is unsatisfactory for snow skiing in which a smooth flat surface is required for the skis. A variety of means of attachment have been patented by various inventors for snow skis ranging from the simple latch mechanism of U.S. Pat. No. 3,801,117, through various coupling designs of U.S. Pat. Nos. 3,825,360; 3,884,315; 4,155,568; 4,248,449 to a number of angled functions best illustrated by U.S. Pat. Nos. 3,596,918 and 3,819,198.

These designs have the disadvantage of requiring a precise fit or put a considerable strain on a single screw which may loosen or snap. The result is a useless ski. The design problems required to produce a number of skis is difficult and some of them require a close precision for precise assembly. This increases expense and causes difficulty in assembly. In addition some ski shoe bindings may be inhibited by the projections present on prior designs.

SUMMARY OF THE INVENTION

As can be seen it is an object of the present invention to overcome the objections of prior art coupling devices by eliminating their drawback and inconveniences. This objective is accomplished by dividing the skis longitudinally into two approximately equal portions which can easily fit into even a compact cars trunk.

Another objective of this invention is to provide a coupling device that is positively secured by at least five locking studs.

A further object of this invention is to provide a means to positively lock the two portions together with a tension devise.

Still another object of this invention is to provide a metal plate which holds both portions of the skis in a locked position.

Yet another object of this invention is to have no extensions that will interfere with the ski boot binding.

A still further object of this invention is to provide a "V" shaped key male portion which can only fit into a female portion.

A final object of this invention is to provide a tension bock that will allow quick and easy assembly of the two portions of the skis.

The foregoing as well as the other objects and the attendant advantages of the present invention become apparent by reading the following detailed description in conjunction with the accompanying drawings which are given merely by way of example. The accompanying claims describe what is considered unique and inventive.

DESCRIPTION OF THE PREFERRED EMBODIMENT

Figure 1:
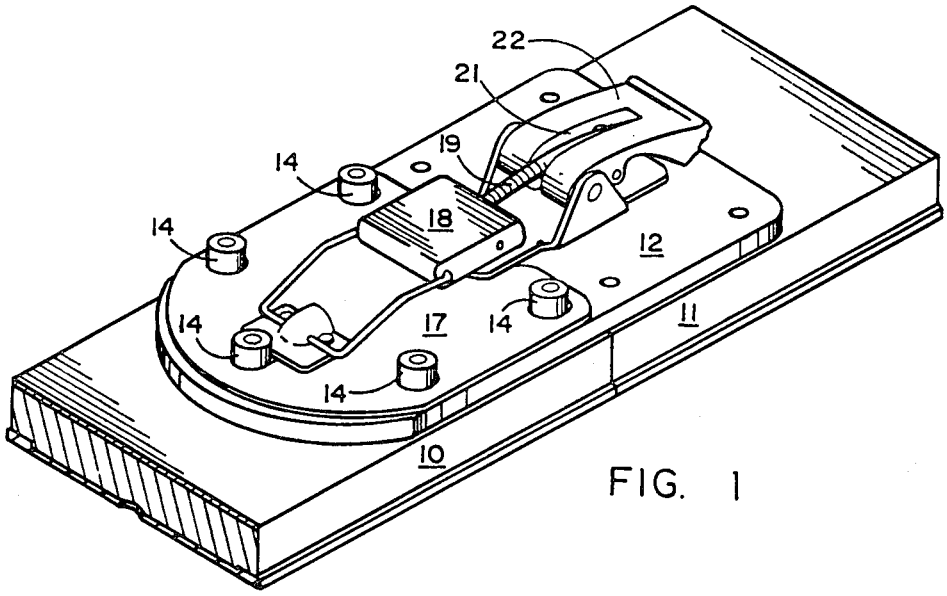
FIG. 1 is an upper perspective view of the two portions connected and in tension.
Figure 2:
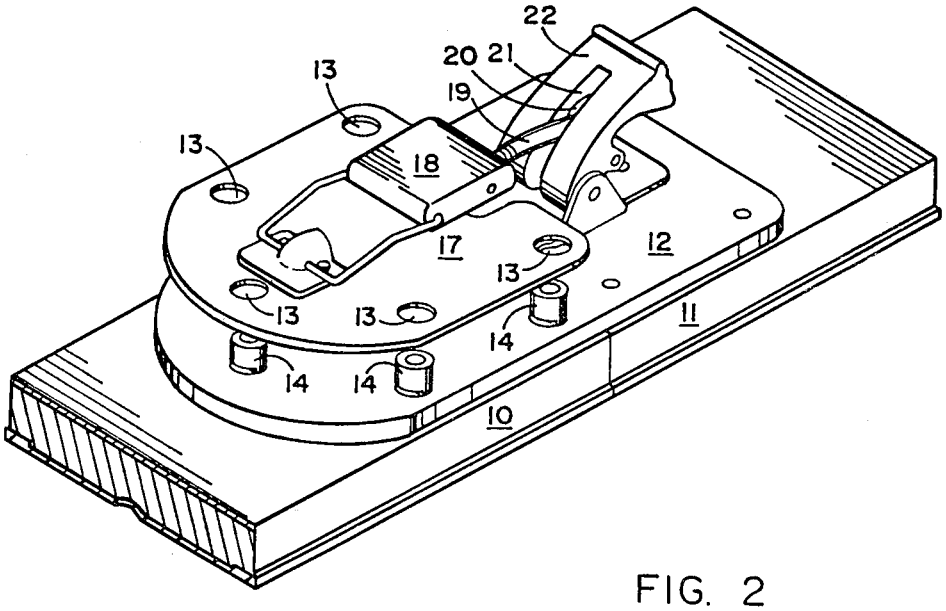
FIG. 2 is an upper perspective view of the two portions connection but not in tension.
Figure 3:
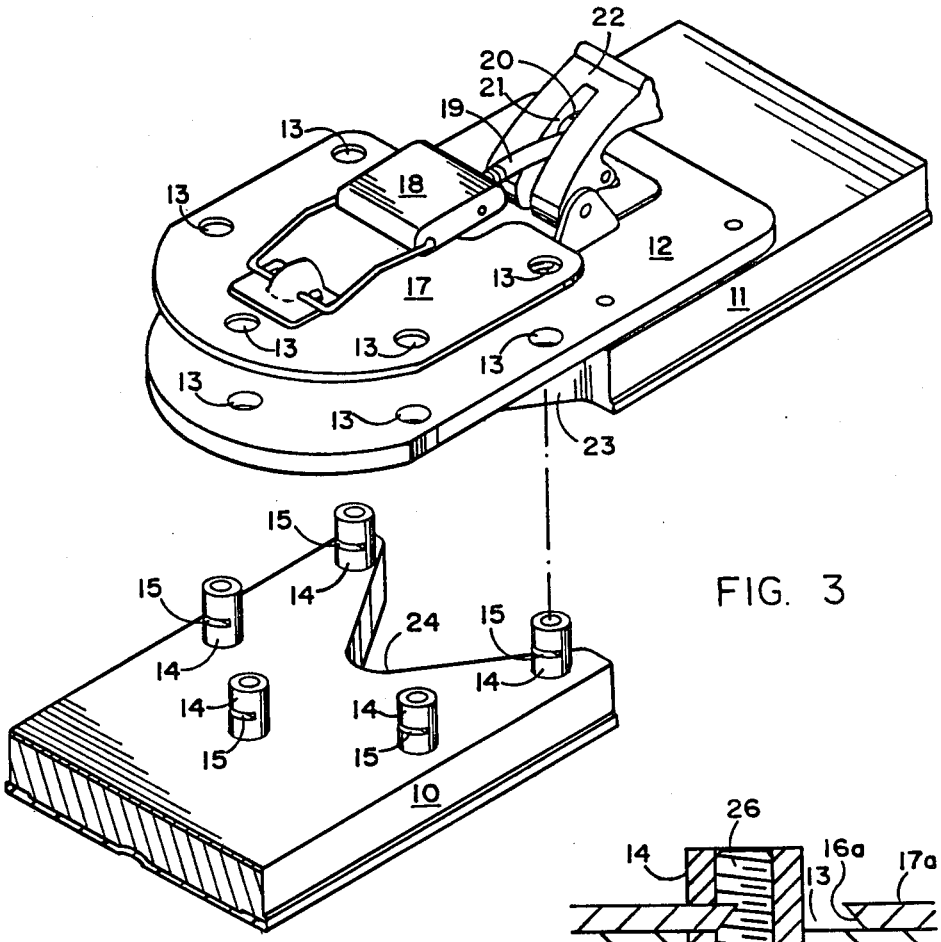
FIG. 3 is an upper view of the two portions of a ski in a disconnected mode.
Figure 5:
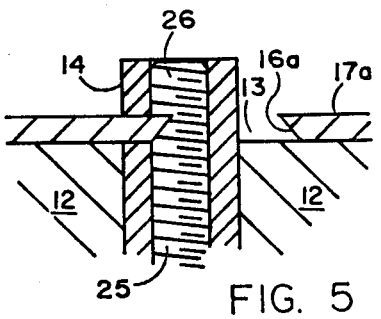
FIG. 5 is an enlarged cross-section of alternate mode of the locking device and bolt.
Figure 4:
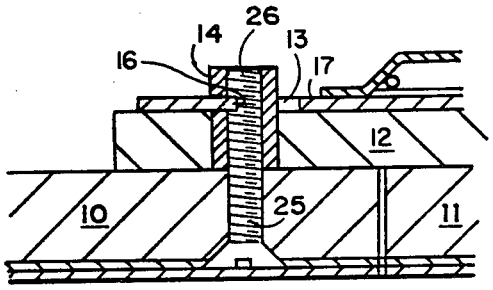
FIG. 4 is an enlarged view of a locking bolt.
Figure 6:
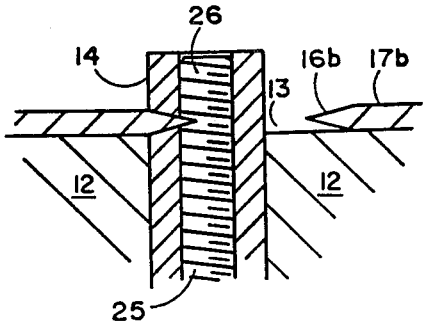
FIG. 6 is an enlarged cross-section of an alternate mode of the locking device and bolt.

The ski is divided into two portions 10 and 11. A metal plate 12 is rigidly attached to portion 11, so that it overlaps portion 10. The metal plate 12 has five holes 13 through which five ferrels 14 which are fastened to portion 10 may pass through. The ferrels are internally threaded and have a slot 15 along the front side to accomodate the edges 16 of the corresponding holes 13 in a metal plate flange 17 that is attached to an adjustable hasp 18. The hasp 18 can be adjusted by rotating adjustable screw 19 which is fastened by head 20 riding outside of slot 21 to moveable lever 22. The skis are used by mating portion 10 and 11 which have a graduated "V" shape on 11 and the female opening 24 on 10. This tends to join the portions together. When 23 and 24 are mated the ferrels 14 slip through holes 13 in plate 12 to fasten the portions together. A tight lock is achieved which makes the ski act as one piece by mating holes 13 in metal plate 17 over the ferrels 14 and forcing the edges 16 of the latter holes 13 into the slots 15. By depressing lever 22 the edges 16 are drawn into slot 15 and are tightly compressed against screw 25. This deforms part of thread 26 and prevents the screw 25 from loosening and the portions of the ski 10 or 11 are locked tightly together. If additional tension is needed to achieve this lock screw 19 is tightened to reduce its length and increase the pull on 18 which increases the tension on 17. The edges 16 are pulled more tightly against bolt 25 until the desired lock is reached.

In another mode the edges 16 may be pointed **16*a* or 16*b* to achieve a greater lock on bolt 25**.

As will be appreciated, the invention may be readily practiced by employing a variety of bindings, shoes and ski structures in connection with the coupling device.

It likewise will be appreciated that more than one coupling or seperateable joint could be incorporated in a ski so as to effect compactness in handling and storage of disassembled ski segments.

In describing the invention the preferred embodiment has been described, modifications are possible and various modes within the spirit of the invention may be devised by those skilled in the art. These are all covered by the appended claims.

I claim:

1. A segmented ski comprizing several segments;

a fore segment;

a generally "V" shaped male block located in the rear of the fore segment;

a rear segment;

a generally "V" shaped female block located in the fore end of the immediate rear segment;

at least three internally threaded ferrels on said rear block to receive machine screws, and lock the segments together;

a slot in each ferrel wall;

a metal plate on said fore section block with as many openings as ferrels in said rear block;

a moveable upper metal plate with the same number of openings said upper plates connected to an adjustable metal hasp;

and means for adjusting the metal hasp so that the upper plate slips over the ferrels and the edge of the upper plate engages the machine screws through the slots of the ferrels.

2. A segment ski coupling device as described in claim 1 in which the adjusting hasp means is a screw whose head is outside a slot, larger than said slot said head being and which can be adjustably rotated to lengthen or shorten the distance the upper metal plate travels when the adjusting means is depressed.

* * * * *